US011324998B2

(12) United States Patent
Amis

(10) Patent No.: US 11,324,998 B2
(45) Date of Patent: May 10, 2022

(54) DEVICE FOR ISOLATED STATIC STRETCHING OF THE GASTROCNEMIUS (CALF) MUSCLE

(71) Applicant: James Amis, Loveland, OH (US)

(72) Inventor: James Amis, Loveland, OH (US)

( * ) Notice: Subject to any disclaimer, the term of this patent is extended or adjusted under 35 U.S.C. 154(b) by 32 days.

(21) Appl. No.: 16/848,750

(22) Filed: Apr. 14, 2020

(65) Prior Publication Data

US 2020/0324164 A1 Oct. 15, 2020

Related U.S. Application Data

(60) Provisional application No. 62/834,094, filed on Apr. 15, 2019.

(51) Int. Cl.

| | |
|---|---|
| ***A63B 23/10*** | (2006.01) |
| ***A63B 23/08*** | (2006.01) |
| ***A63B 23/00*** | (2006.01) |

(52) U.S. Cl.

CPC ..... *A63B 23/10* (2013.01); *A63B 23/08* (2013.01); *A63B 2023/006* (2013.01)

(58) Field of Classification Search

CPC ... A63B 2225/093; A63B 23/10; A63B 23/08; A63B 2023/006; A63B 21/40; A63B 23/045; A63B 2208/02; A61H 2201/0161; A61H 2201/0107; A61H 2201/0157; A61H 1/0266; A61H 1/0237; A61H 2201/164; A61H 2201/1284

See application file for complete search history.

(56) References Cited

U.S. PATENT DOCUMENTS 4,253,661 A * 3/1981 Russell ..... A63B 21/00047 482/79
4,603,851 A * 8/1986 Russell ..... A63B 69/0035 482/79
5,048,823 A * 9/1991 Bean ..... A63B 22/18 482/146
5,056,507 A * 10/1991 Yum ..... A61H 7/001 601/136
5,087,036 A * 2/1992 Cooper ..... A63B 23/085 482/79
5,184,987 A * 2/1993 Wilkinson ..... A63B 23/0458 482/52
5,284,465 A * 2/1994 Homan, Jr. ..... A63B 23/0405 482/79
5,669,089 A * 9/1997 Dees ..... B25H 5/00 5/722
5,743,831 A * 4/1998 Jakich ..... A63B 23/0458 482/52
6,042,520 A 3/2000 Cantero
6,244,992 B1 * 6/2001 James ..... A61H 1/0237 482/79
6,425,843 B1 7/2002 Storfer et al.
(Continued)

*Primary Examiner* — Garrett K Atkinson
(74) *Attorney, Agent, or Firm* — Jenei LLC

(57) ABSTRACT

A calf-stretching device enables a user to conduct stretching exercises of the gastrocnemius muscles of the leg. The calf-stretching device includes a support base positionable on a floor surface and left and right surfaces immovably attached to the support base. Each of the left and right surfaces present a convex curved surface from a front side to a back side to receive respective feet of the user, the convex curved surface having a greater radial dimension on an inner portion than an outer portion to correspond to a foot arch of the user.

4 Claims, 7 Drawing Sheets

(56) References Cited

U.S. PATENT DOCUMENTS 6,589,141 B1 * 7/2003 Flaggs ..... A63B 23/04 482/79
7,169,098 B1 * 1/2007 McGanty ..... A61H 1/0237 482/79
7,857,733 B2 * 12/2010 Tsakiris ..... A63B 21/00047 482/52
9,259,343 B2 * 2/2016 Newman ..... A61F 5/0111
9,415,260 B2 * 8/2016 Islas ..... A63B 21/4034
9,457,226 B2 * 10/2016 Heath ..... A63B 21/0004
D797,996 S * 9/2017 Wade ..... D28/63
D801,583 S * 10/2017 Wade ..... D28/63
9,931,264 B2 * 4/2018 Nielsen ..... A61F 7/10
10,206,845 B1 * 2/2019 Barouche ..... A61H 1/0237
10,219,967 B2 * 3/2019 Nielsen ..... A61H 15/00
10,265,571 B2 * 4/2019 Ban ..... A61H 1/0292
10,434,357 B2 * 10/2019 McCarthy ..... A63B 21/0421
10,549,142 B1 * 2/2020 Ash ..... A61H 1/0266
10,744,056 B2 * 8/2020 Nielsen ..... A61F 7/10
2007/0249476 A1 * 10/2007 Hill ..... A63B 21/00047 482/148
2011/0098614 A1 * 4/2011 McKenzie ..... A63B 22/16 601/136
2011/0124473 A1 * 5/2011 Kole ..... A63B 21/02 482/79
2011/0152047 A1 * 6/2011 Bedard ..... A63B 23/085 482/142
2012/0040810 A1 * 2/2012 Astilla ..... A63B 21/0023 482/131
2013/0053228 A1 * 2/2013 Winegar ..... A63B 22/16 482/146
2014/0100086 A1 * 4/2014 Pagliaro ..... A61H 1/0237 482/91
2014/0274589 A1 * 9/2014 Harkins ..... A63B 21/0023 482/91
2015/0351573 A1 * 12/2015 Heath ..... A63B 22/18 428/178
2016/0279012 A1 * 9/2016 Hurtado ..... A61H 35/006
2018/0085623 A1 * 3/2018 Flook ..... A63B 21/4027
2018/0271735 A1 * 9/2018 Drucker ..... A63B 21/4037
2019/0159920 A1 5/2019 Digiovanni et al.
2019/0160322 A1 * 5/2019 McCarthy ..... A63B 21/4034

* cited by examiner

DEVICE FOR ISOLATED STATIC STRETCHING OF THE GASTROCNEMIUS (CALF) MUSCLE

CROSS-REFERENCE TO RELATED APPLICATIONS

This application claims the benefit of priority under 35 U.S.C. § 119(e) to U.S. Patent Application Provisional Application Ser. No. 62/834,094, entitled "DEVICE FOR ISOLATED STATIC STRETCHING OF THE GASTROCNEMIUS (CALF) MUSCLE", filed Apr. 15, 2019, the contents of which are hereby incorporated by reference in their entirety for any purpose.

BACKGROUND

1. Technical Field

The present invention relates to exercise equipment in general and to exercise equipment for the heel flexors, toe flexors and calf muscles in particular.

2. Description of the Related Art

Devices are known to assist in stretching, such as U.S. Pat. No. 6,425,843 to Storfer, et al., the disclosure of which is hereby incorporated by reference in its entirety. Stretching of the muscles in preparation for athletics is intended to increase performance and reduce the risk of injury. As many forms of athletics, as well as normal daily life, involve the use of the legs, it is important that the various leg muscles be properly stretched. Particularly important are the calf muscles.

In stretching the calf muscles, it is important to understand that not only are the muscles being stretched, but to a minor degree so is the Achilles tendon. The Achilles tendon attaches to the calf muscle and to the heel bone (calcaneus). The calf muscles and the muscles along the shin are needed to protect against shock in various exercises involving the legs. In athletics, the Achilles tendon bears forces up to six times that of a person's weight. If not stretched properly or if overused, the Achilles tendon may become injured to the point of rupturing.

As it pertains to the calf muscles and the Achilles tendon in particular, the best stretch is one done slowly and with proper support maintaining control of stretch of intensity. One generally used method of stretching the calf muscles can be particularly dangerous. That is, standing on a step with the heel of the foot hanging off and then dropping down to stretch the calf muscle. In this method, the muscles and tendons may be stretched past the point in which they will have to move. Most of the current devices and methods lack the ability to control the intensity of the stretch of stretches and thus may over stretch the calf and Achilles tendon. Proper stretching should be done slowly and carefully.

BRIEF SUMMARY

In accordance with the teachings of the present disclosure, a calf-stretching device is provided for conducting stretching exercises of the gastrocnemius muscles of the leg. The calf-stretching device includes a support base positionable on a floor surface. The calf-stretching device includes left and right surfaces (components) that are immovably connected to the support base. Each of the left and right surfaces present a convex curved surface from a front side to a back side to receive respective feet of a user. The convex curved surface has a greater radial dimension on an inner portion than an outer portion presenting a varus slant to correspond to a foot arch of the user.

The above presents a general summary of several aspects of the disclosure in order to provide a basic understanding of at least some aspects of the disclosure. The above summary contains simplifications, generalizations and omissions of detail and is not intended as a comprehensive description of the claimed subject matter but, rather, is intended to provide a brief overview of some of the functionality associated therewith. The summary is not intended to delineate the scope of the claims, and the summary merely presents some concepts of the disclosure in a general form as a prelude to the more detailed description that follows. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
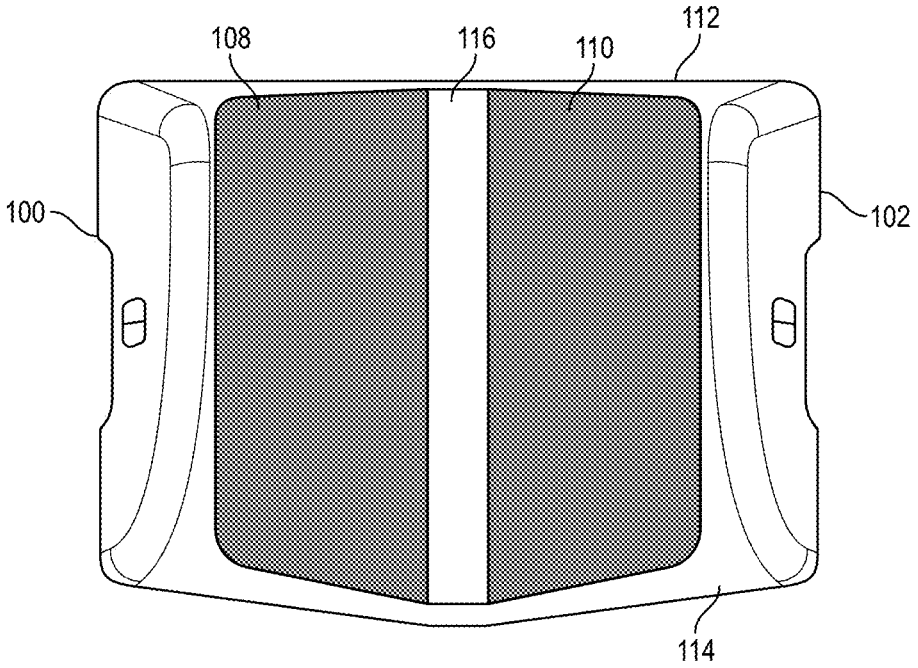
FIG. 1 is a top view illustrating a first example calf-stretching device, according to one or more embodiments.
Figure 2:
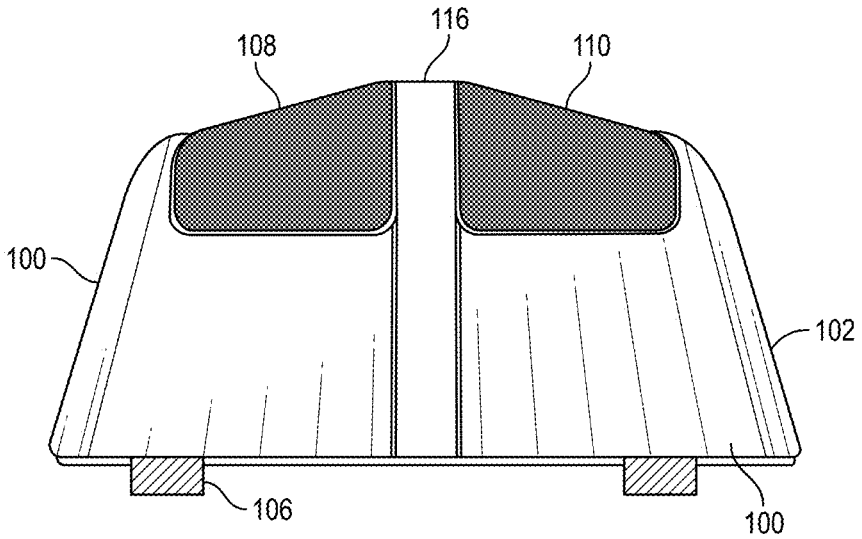
FIG. 2 is a rear view illustrating a first example calf-stretching device, according to one or more embodiments.
Figure 3:
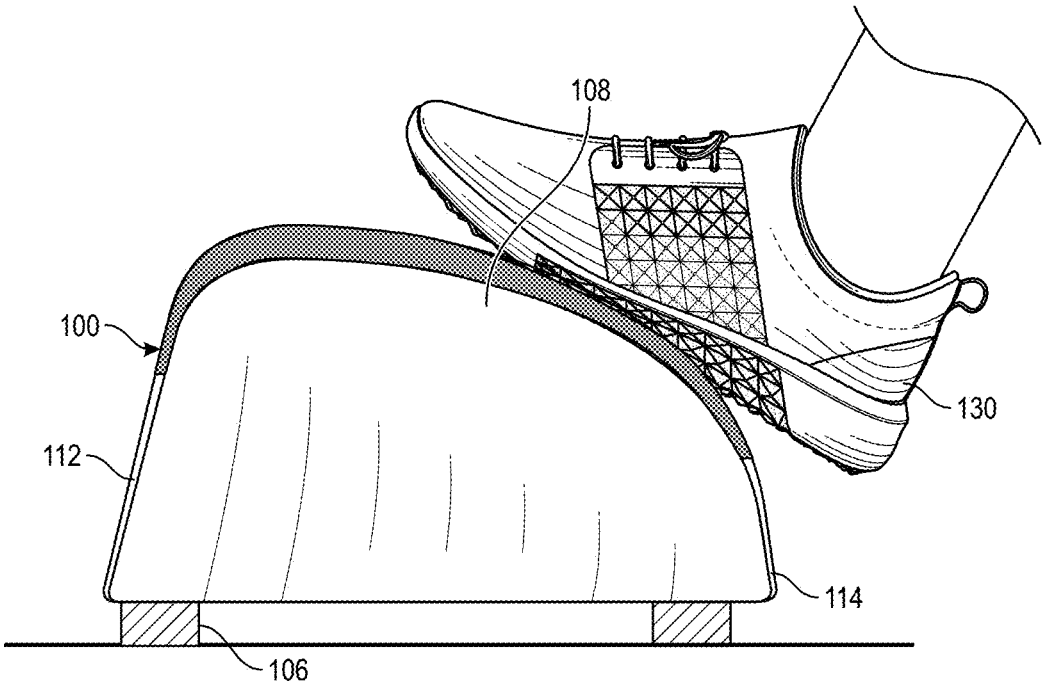
FIG. 3 is a left side view illustrating the first example calf-stretching device of FIG. 1 being used in a back-to-the-wall technique by a user, according to one or more embodiments.
Figure 4:
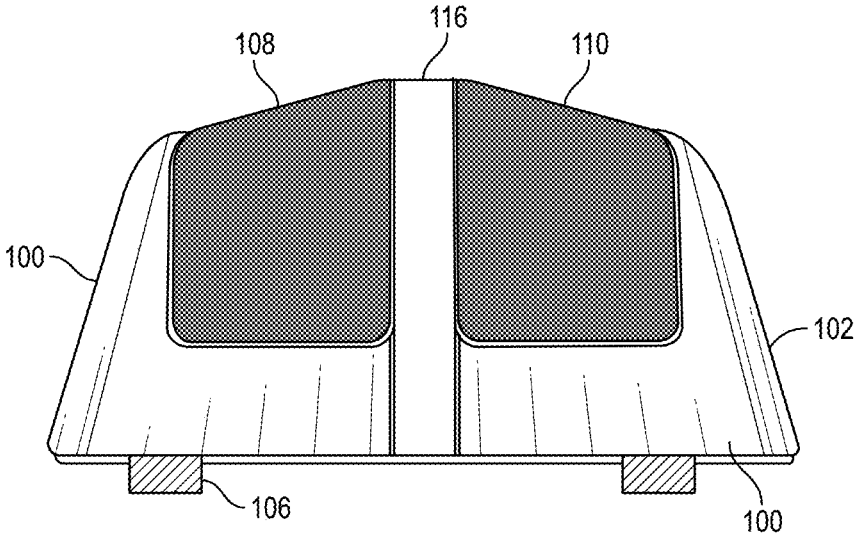
FIG. 4 is a front view illustrating the first example calf-stretching device of FIG. 1, according to one or more embodiments.

FIGS. 1-4 illustrate example calf-stretching device 100 that enables a user to conduct flexion exercises of the gastrocnemius muscles of the leg. Calf-stretching device 100 includes a support base 102 positionable on a floor surface 104. A resilient, high-friction under-surface, such as rubber feet 106, of the support base 102 resists lateral movement, enabling a back-against-a-wall technique of calf stretching. Calf-stretching device 100 includes left and right surfaces 108, 110 immovably attached to support base 102. Each left and right surfaces 108, 110 present a progressive radius, convex curved surface from a front side 112 to a back side 114 to receive respective feet of the user, the convex curved surface having a greater radial dimension on an inner portion than an outer portion to correspond to a foot arch of the user. In one or more embodiments, a center ridge 116 separates left and right surfaces 108, 110. Passive stretching is the act of lengthening a muscle and to a minor degree its tendon by applying an external lengthening force. Passive stretching is universally known to be the optimal, therefore preferred method to stretch or lengthen any musculotendinous unit. In the case of the calf, passive stretching can be easily performed by using one's body weight without the need of an assistance of a partner or additional weights.

"Progressive radius" of the curvature of the stretching surfaces means that the radius of curvature of the stretching surfaces changes along the perimeter of the device. The progressive radius of the curvature allows for variable stretching intensity depending on the location chosen where the feet are placed.

Each left and right surfaces 108, 110 present a progressive radius, convex curved surface from a front side 112 to a back side 114 to receive respective feet of the user, the convex curved surface having a greater radial dimension on an inner portion than an outer portion to correspond to a foot arch of the user.

Calf-stretching device 100 provides for left and right surfaces 108, 110 having a progressive radius of curvature. In one or more embodiments, the progressive, non-static radius should be between about 5 and 36 inches. In one or more embodiments, the higher curvature, short radius area, the radius of curvature should begin between about 5 and 24 inches. In the lower curvature, long radius area, the radius of curvature should begin between about 14 and 36 inches. The middle portion of the progressive radius of curvature of the left and right surfaces 108, 110 should fall between 14 to 16 inches. The wide range of radius of curvature of provides for support to a wide range of foot sizes. Where the apparatus is made for a particular population, the radius of curvature may be adjusted. For example, younger athletes or women with their smaller foot sizes may find a smaller range of radius of curvature appropriate. Conversely, professional basketball players with their larger foot sizes may find a larger range of radius of curvature appropriate. In an exemplary embodiment, a wide range of progressive radii is provided so that no matter the size of the foot in contact, the angle of stretch can be "dialed in", depending on the radius of the particular place where the foot makes contact. The tangent of where the foot makes contact can be unique to the size of the foot. An infinite adjustability is provided by the progressive radius of curve.

The calf-stretching device 100 is different than all existing calf stretching methods and devices. In general calf-stretching device 100 allows the user to stretch the calf more aggressively, more safely, and with the most relaxed effort available. Being fully relaxed is essential to obtain the most effective passive stretch. Compliance is always an issue with any medical treatment or exercise regimen, especially with a boring exercise such as stretching. Calf-stretching device 100 will definitely increase compliance because of advantages noted below. It is just easier to get the job done.

To perform the stretch, the device is placed a certain distance away from any wall. Typically this distance is approximately the length of the individual's shoed foot. The person then stretches by placing the forefoot on calf-stretching device 100 with their knees straight and back straight, against the wall. Then the heels are allowed to drop downward with the weight of the body and gravity producing a stretch on the calf and the Achilles tendon.

Aspects of the present innovation provide: (i) Variable intensity; (ii) Infinite stretching positions; (iii) progressive radius stretching surface allowing a user to select a desired intensity of the stretch; (iv) Isolates the stretch to get the best passive stretch of the calf, and particularly the gastrocnemius or upper part of the calf; and (v) Pure passive stretch. "Passive stretch" refers to encouraging the user to be relaxed, such as including an ability to support the body partially against a wall. As any physical therapist will tell you, the more passive the stretch is the better. The user is relaxed allowing the stretch to occur without any effort by the user. Other devices absolutely require your efforts to maintain balance and to hold onto something to secure yourself, which reduces an ability to get a passive stretch. The calf-stretching device 100 may be fabricated using various method including rotational molding, blow molding or injection molding.

Figure 5:
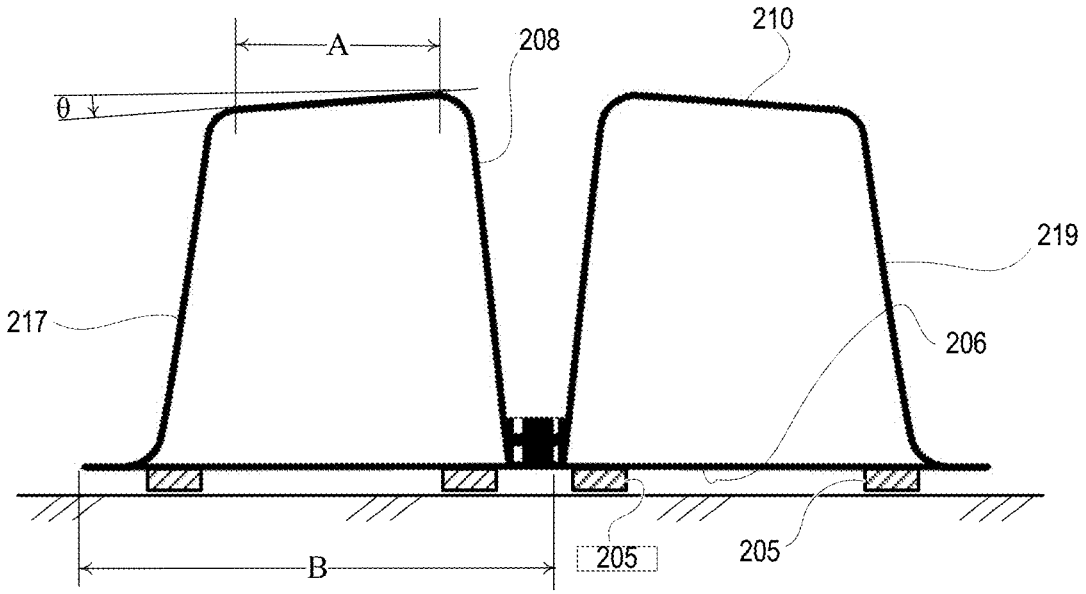
FIG. 5 is a rear view illustrating a second example calf-stretching device having a two-piece support base, according to one or more embodiments.
Figure 6:
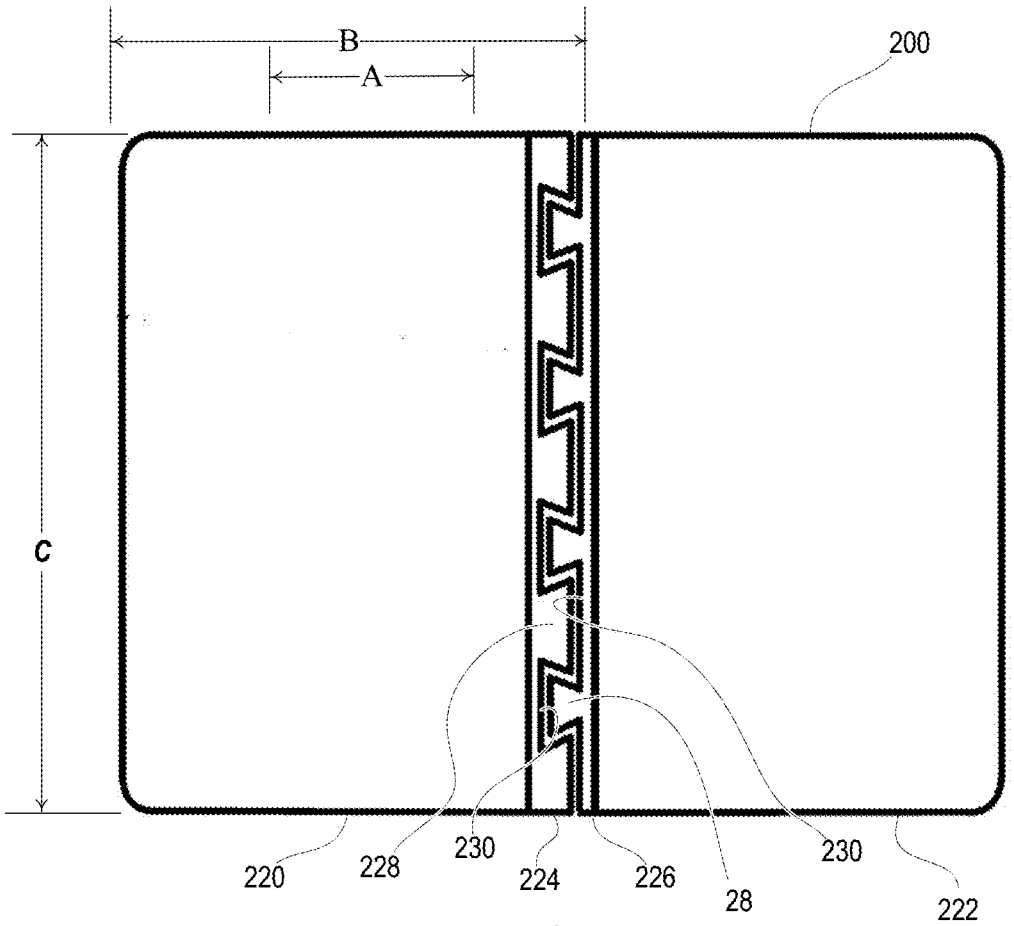
FIG. 6 is a top view illustrating the second example calf-stretching device of FIG. 5 having the two-piece support base, according to one or more embodiments.
Figure 7:
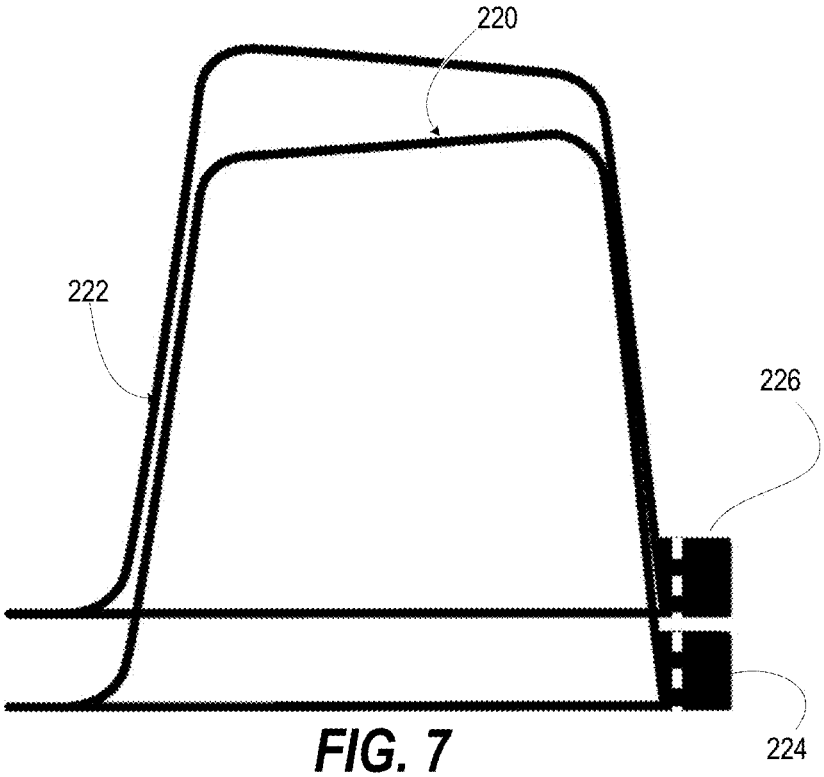
FIG. 7 is a rear view illustrating the second example calf-stretching device of FIG. 5 having the two-piece support base disassembled and positioned in a nested stack, according to one or more embodiments.

FIGS. 5-7 illustrate an example calf-stretching device 200 that has enhanced portability and reduced storage requirements. With particular reference to FIG. 5, calf-stretching device 200 includes a two-piece support base 202 positionable on a flooring surface 204. Support base 202 has resilient, high-friction feet 205 attached to under-surface 206 of the support base 202 that resist lateral movement, enabling a back-against-a-wall technique of calf stretching. The convex curved surface of left and right surface 208, 210 of support base 202 each have downward slant toward each respective lateral left and right side 217, 219. In one or more embodiments, the left and right surface 208, 210 of support base 202 each have downward slant toward each respective lateral left and right side 217, 219 of 5-25 degrees. In another embodiment, the left and right surface 208, 210 of support base 202 each have downward slant toward each respective lateral left and right side 217, 219 of 10-20 degrees. In another embodiment, the left and right surface 208, 210 of support base 202 each have downward slant toward each respective lateral left and right side 217, 219 of 12-18 degrees. In another embodiment, the left and right surface 208, 210 of support base 202 each have downward slant toward each respective lateral left and right side 217, 219 of 15 degrees.

Two-piece support base 202 includes left and right nestable shells 220, 222 respectively attached to left and right surfaces 208, 210 and respectively comprising corresponding attachment surfaces 224, 226. FIG. 6 illustrates that corresponding attachment surfaces 224, 226 can comprise complementary dovetail flanges 228 and apertures 230.

Figure 8:
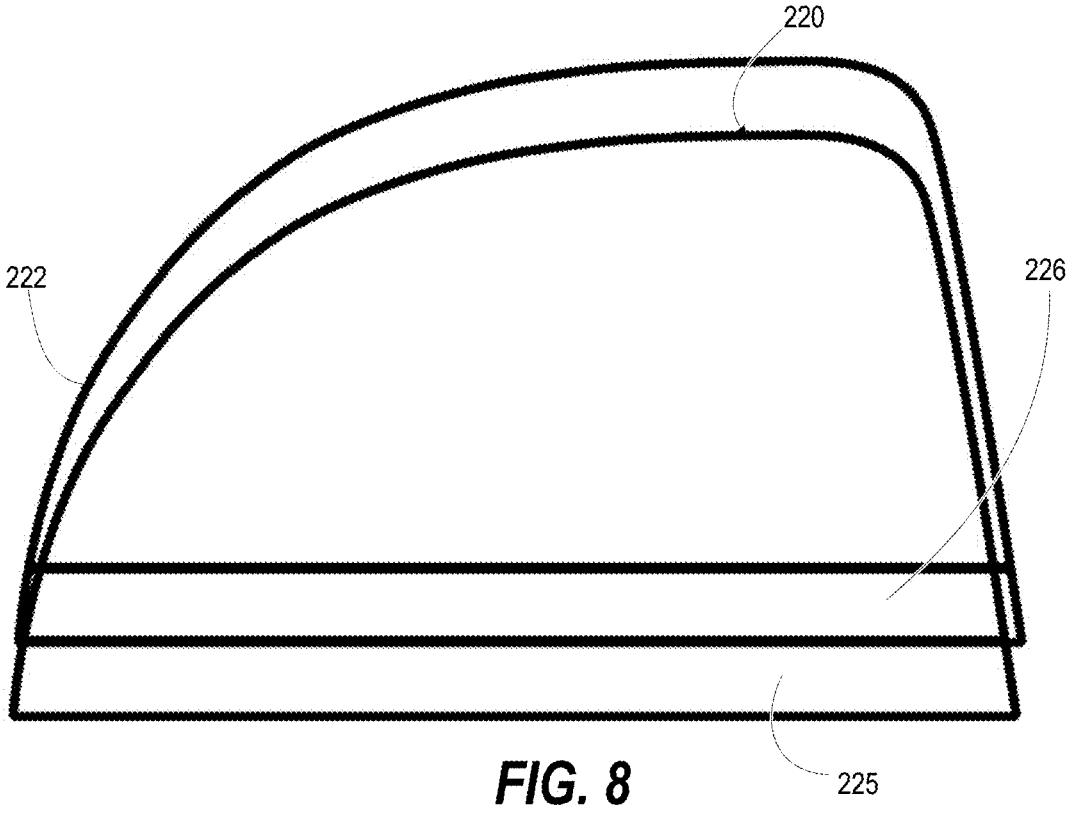
FIG. 8 is a right side view illustrating the second example calf-stretching device of FIG. 5 having the two-piece support base disassembled and positioned in the nested stack, according to one or more embodiments.

In an exemplary embodiment, in FIG. 5 left and right surface 208, 210 of support base 202 present an upper lateral dimension of "A", such as 4, 5, 6, 7 inches or more. Left and right nestable shells 220, 222 present a lower lateral dimension of "B", such as 5, 6, 7, 8, 9, 10 inches or more. In FIG. 6, Left and right nestable shells 220, 222 present a lower longitudinal dimension of "C" from front to back side, such as 8, 10, 12, 14 inches or more. FIGS. 7-8 illustrate Left and right nestable shells 220, 222 detached and positioned in a nested stack for shipping and storage. FIG. 8 illustrates that left and right surface 208, 210 each are progressively curved surfaces with an amount of curvature increasing from front to back.

Calf-stretching device 200 also enables "Back to wall" positioning during the stretching, which is: (i) easy on the knees that remain straight or the knees can be flexed if needed; and (ii) the back is relaxed and supported by the wall. The body does not need to be balanced over the stretching device which allows the person to better relax into the stretch without strain to the back or the knees. With your back against the wall you face the room and as a consequence you do not face the wall or stairs. In addition your hands are free so that you can use them to read the paper or drink coffee or look at your smart phone for example. In the spirit of the familiar quote "if you make it they will come", well "if you make it easier they will actually do it".

Calf-stretching device 200 is dual, yet differential stretching. Both calves can be stretched with the exact same intensity at the same time. Due to the progressive radius of the curvature of the stretching surfaces, one calf can take on a more aggressive stretch, while the other calf is stretched with less or no intensity. The roll off or gentle curvature is safer and more comfortable for the foot. This may improve compliance as well. The progressive curve isolates the stretch to the calf, and not to the foot or ankle or Achilles unlike any other method or device. The result is that all of the stretch goes to the calf where it is needed.

Small fixed radius stretching surface is a stretching surface on the opposite side of the progressive radius stretching surface which allows maximal clearance of the heel to give the most aggressive stretch. Flared sides of the nestable shells 220, 222 produce a wider stable base which cannot be tipped over.

In one or more embodiments, calf-stretching device 200 can be made of high and low density polyethylene using a rotational molding process. In one or more embodiments, calf-stretching device 200 can be made by injection molding with ABS plastic or other materials. In one or more embodiments, calf-stretching device 200 is made with multi-material molding (MMM) in a single mold. Other methods may be employed according to aspects of the present innovation. EVA foam top piece provides secure traction for the foot or shoe to stop slipping. This appears only to be a safety feature, but a firm grip assists in obtaining a proper relaxed stretch. The cushioning of the foam is easy on the foot to make the stretch more comfortable again promoting compliance.

The present innovation provides better stretching than generally-known stretching methods. There are basically six devices/methods available to assist in passively stretching the calf/Achilles tendon. These consist of a simple step, strap method, a slant board, the Pro-Stretch device, and a night splint. While these methods can and do stretch the calf/Achilles, each one has significant limitations. The simplest and most portable method is lean against the stretch against the wall method. This is the least effective method. Use of a step or stair is the closest method to calf-stretching device 200, however, it is difficult to control the intensity of the stretch, which can be a significant problem. In addition, getting to enough of a relaxed state to get the best passive stretch is difficult for the step method. In fact, this applies to all of these methods. It is also boring, so compliance is an issue. This is the method I have taught and had my patients use for years, but eventually due to lack of compliance I figured out there could be a much better way. Even though the night splint is passive, it gives a very poor, weak stretch simply because the advantage of using the body weight is not used. In addition the night splint can cause sleep disturbance due to its presence on the foot and leg and being poorly tolerated. While the Pro-Stretch rocker and the slant board appear to be straight forward, both are actually awkward in their application and use. One can get a fairly good stretch with either device, but it takes considerable effort to obtain a satisfactory stretch. It is particularly difficult to fully relax during the stretch using these devices and the advantage of an effective passive stretch is less effective. Also since there is a limit to the amount of dorsiflexion of the ankle the aggressiveness of the stretch is limited. Finally, because of the awkwardness of these devices, the need to use the upper extremities during the stretch, the need to face the wall, etc., compliance is much less achievable.

In one or more embodiments, calf-stretching device 200 can be ABS plastic or similar material made from two injection molds, right and left. The ideal would be a two material, two shot molding process or 2K molding like a toothbrush. The feet and the top rubber mat would be the second material. The center is hollow basically like two cups. The advantages can include: (i) Reduced footprint for retail commercialization; (ii) Reduced weight (and size) for shipping costs; and (iii) For the customer, easy storage, portable, even travel.

In one or more embodiments, rather than a single radius curve, the calf-stretching device 200 has a progressive radius curve toward the center that transitions to and a second, smaller single radius curve toward the outside.

In one or more embodiments, the varus slant can be adjusted to correspond to an amount of arch support presented by the shoes of the user or the foot of the user. For example, the 15 degree slant could be increased or decreased by 0.5. 1, 2, 3, 4 or 5 degrees. In one or more embodiments, the varus slant is at least 5, 6, 7, 8, 9, 10, 11, 12, 13, 14, 15 or more degrees. In one or more embodiments, the varus slant is at most 25, 24, 23, 22, 21, 20, 19, 18, 17, 16, 15 or fewer degrees. In one or more embodiments, the varus slant can be in the range of from about 10-20 degrees, 11-19 degrees, 12-18 degrees, 13-17 degrees, or 14-16 degrees, depending upon the slant necessary for a particular user. Matching the feet of the user allows simultaneous stretching of both feet comfortably.

Progressive radius curve of top curve stretches the human calf, and thus correcting equinus, isolated gastrocnemius contracture or a calf that is too tight. Without the benefit of proper stretching, which is common, the tight calf silently creates damage to the human foot. The inventor believes that it amounts to causing 65% of all non-traumatic acquired foot and ankle pathologies and each is preventable as well as treatable by calf stretching. Calf-stretching device 200 is a personal use device intended to provide an isolated static stretch of the gastrocnemius muscle. The gastrocnemius stretch is maximized by the unique varus/supination slant, which locks the hind foot creating a rigid foot lever directing the stretch completely to the gastrocnemius. The anti-slip feet allow the user to relax back against the wall creating the best passive stretch allowing the user to achieve complete relaxation into the stretch.

Supporting your arch while you stretch is essential. This support provided by the progressive top curvature makes the calf-stretching device 200 safer and your feet feel better. It also stretches the plantar fascia simultaneous to the calf stretch. No other product or method provides support for your arches while you stretch your calves like calf-stretching device 200. Calf-stretching device 200 enables a unique back against the wall method which results in locking of the knees, creating a pure stretch of the muscle that needs it: the gastrocnemius.

Figure 9:
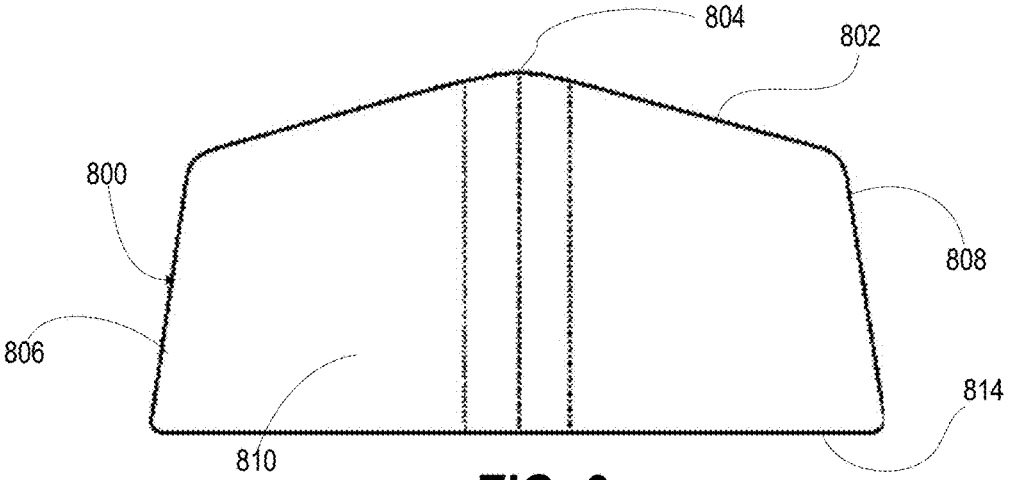
FIG. 9 is a rear view illustrating a third example calf-stretching device having progressive curvature, according to one or more embodiments.
Figure 10:
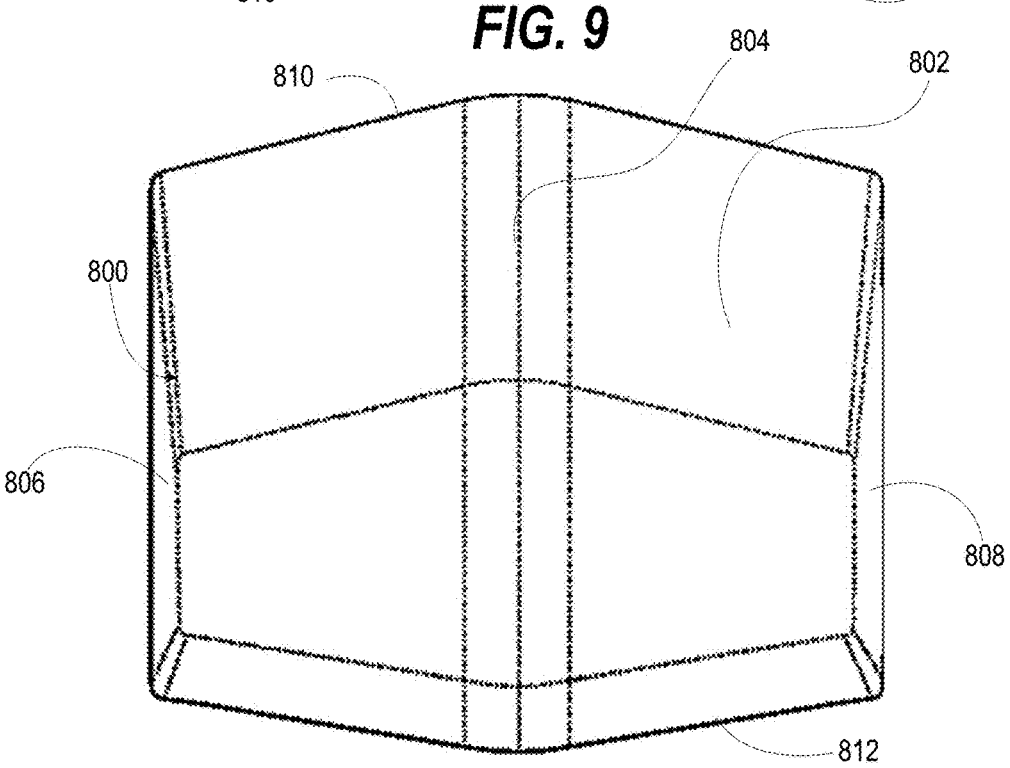
FIG. 10 is top view illustrating the third example calf-stretching device having the progressive curvature, according to one or more embodiments.
Figure 11:
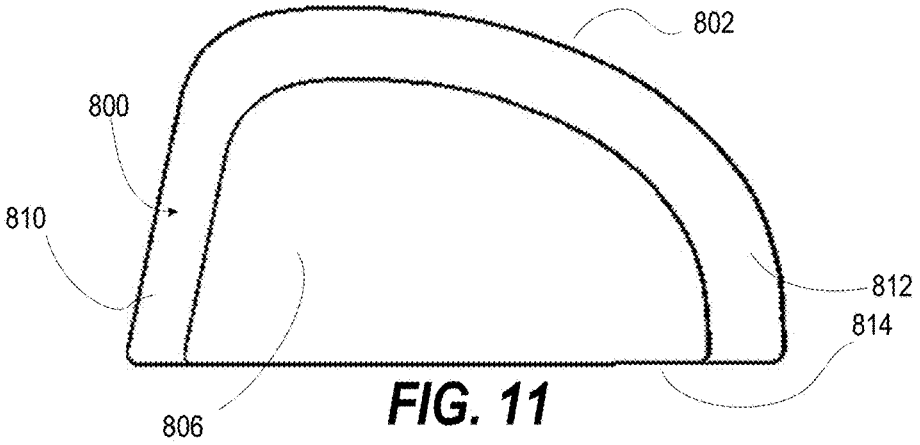
FIG. 11 is a left side view illustrating the third example calf-stretching device having the progressive curvature, according to one or more embodiments.
Figure 12:
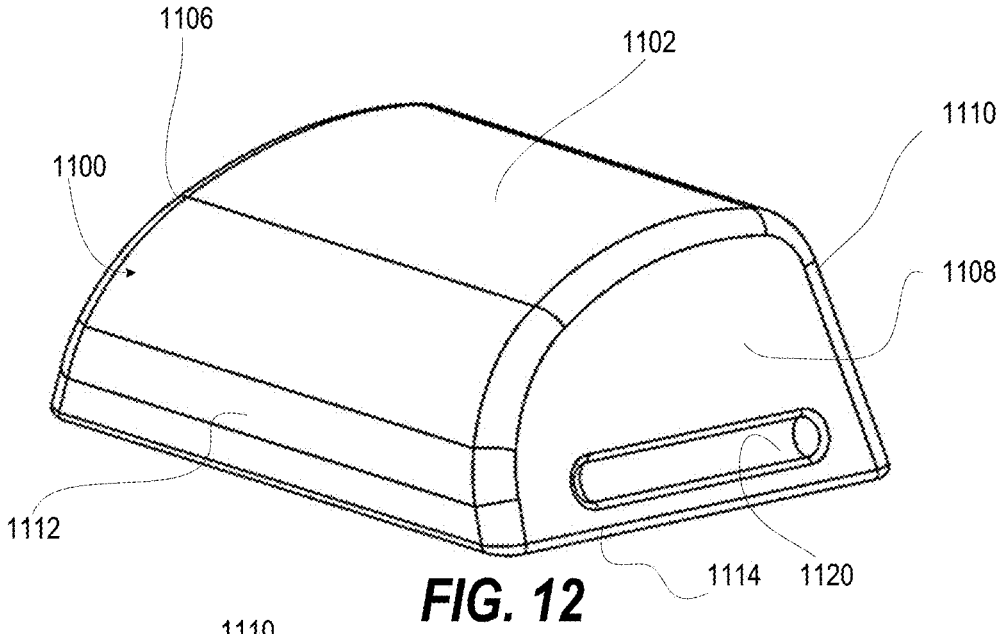
FIG. 12 is front left isometric view illustrating a fourth example calf-stretching device, according to one or more embodiments.

FIGS. 9-111 illustrate a third example calf-stretching device 800 having a front-to-back progressively curved top surface 802 (FIG. 11) that enables selecting how hard the stretching force is. In addition, the top surface 802 is highest in the lateral center 804 (FIG. 9), sloping downward to both left and right. Each foot experiences support for the arches by this lateral sloping. Lateral positioning can also assist in finding an appropriate overall diameter that is appropriate for the size of the foot. Lateral sides 806, 808 diverge horizontally as does front side 810 from back side 812 to provide a wide base 814 for stability and frictional engagement to the floor.

Figure 13:
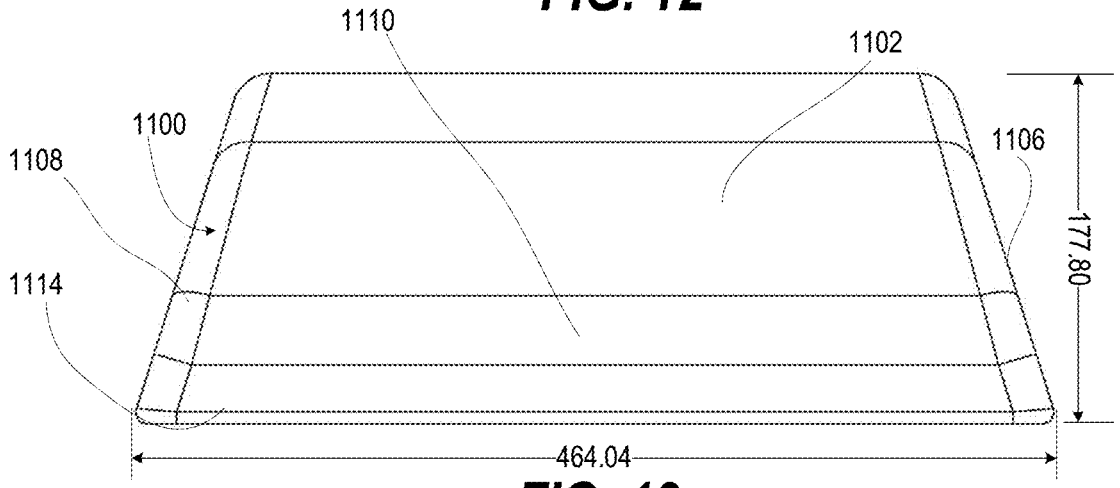
FIG. 13 is a rear view illustrating the fourth example calf-stretching device, according to one or more embodiments.
Figure 14:
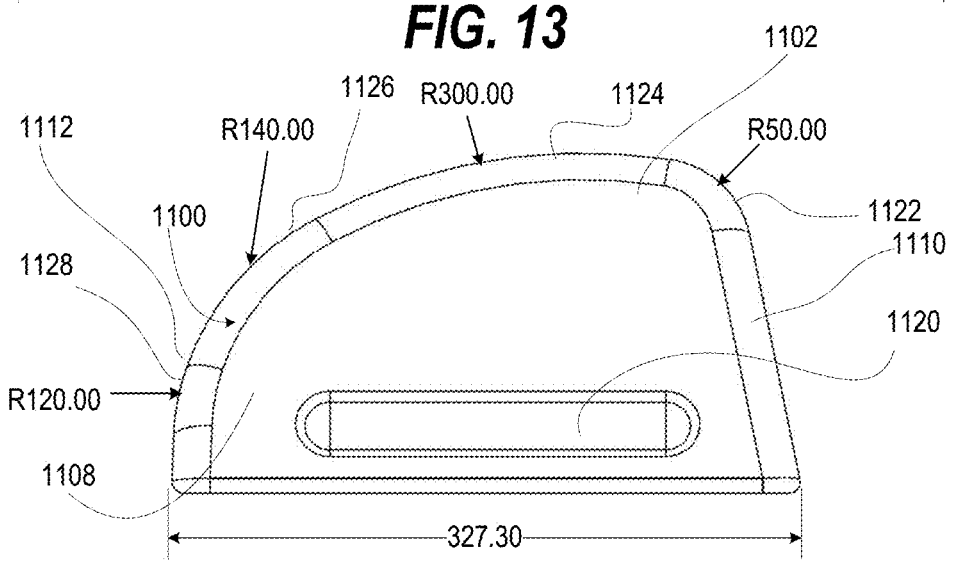
FIG. 14 is right side view illustrating the fourth example calf-stretching device, according to one or more embodiments.
Figure 15:
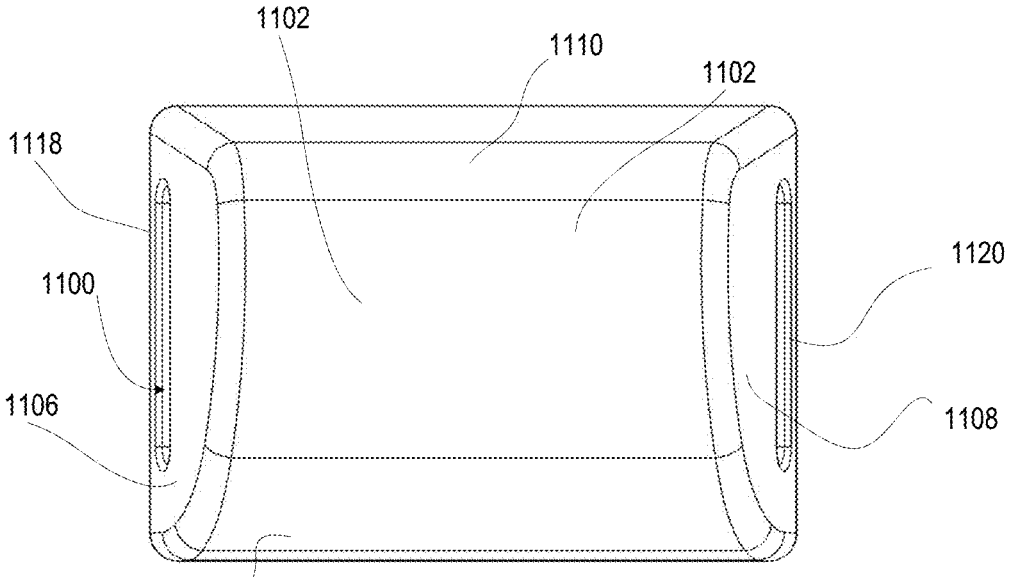
FIG. 15 is top view illustrating the fourth example calf-stretching device, according to one or more embodiments.
Figure 16:
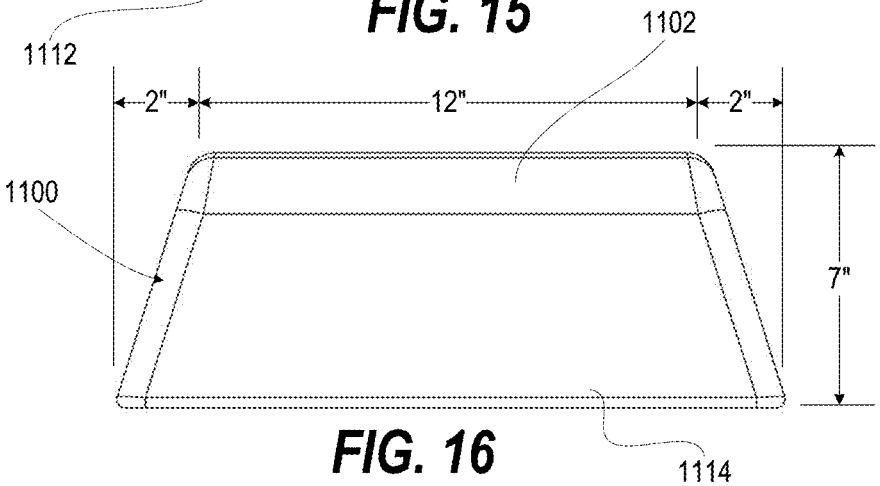
FIG. 16 is front view illustrating the fourth example calf-stretching device, according to one or more embodiments.
Figure 17:
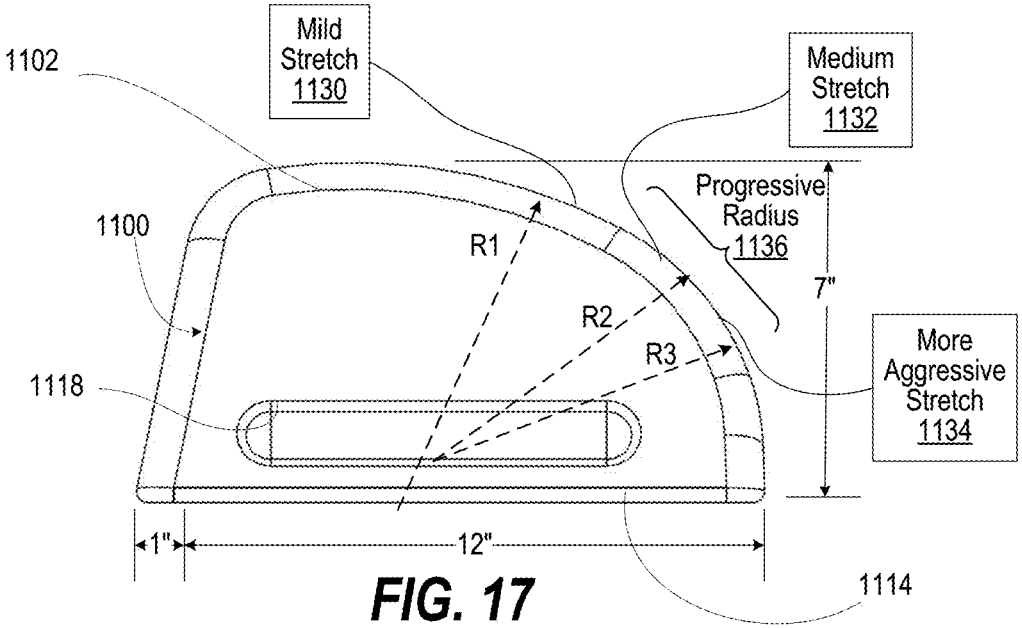
FIG. 17 is a left side view illustrating the fourth example calf-stretching device, according to one or more embodiments.

FIGS. 12-17 illustrate a fourth example calf-stretching device 1100 having a front-to-back progressively curved top surface 1102 that enables selecting how hard the stretching force is. Left and right lateral sides 1106, 1108 diverge horizontally as does front side 1110 from back side 1112 to provide a wide base 1114 for stability and frictional engagement to the floor. Left and right lateral sides 1102, 1108 include lateral depressions 1118, 1120 respectively. FIG. 13 illustrates that in one or more embodiments, calf-stretching device 1100 is 177.80 mm high (7 inches) and 464 mm wide (16 inches). FIG. 14 illustrates that in one embodiment progressively curved top surface 802 begins with radius portion 1122 has a radius of 50.00 mm ("R50.0"). Moving backward, the next radius portion 1124 has a radius of 300.00 mm ("R300.0"). The next radius portion 1126 has a radius of 140.00 mm ("R140.0"). The next radius portion 1128 has a radius of 120.00 mm ("R120.0"). FIG. 16 illustrates that, for lateral stability, a straight top edge 1129 is 12 inches wide between left and right sides 1106, 1108 that respectively slope away 2 inches. FIG. 17 illustrates that a forward radius ("R1") provides mild stretch 1130. A middle radius ("R2") provides medium stretch 1132. A rear radius ("R3") provides a more aggressive stretch 1134. The progressive radius 1136 of the curvature increases progressively in a circumferential direction around an axis from a minimum radius at forward radius ("R1") along the top surface of the device, increasing to a maximum radius towards a rear radius ("R3"). This changing progressive radius 1136 enables customized calf stretching. Longitudinal length of the base 1114 includes 12 inches under top surface 1102 with an additional inch under the front side 1110.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A calf-stretching device for conducting flexion exercises of the gastrocnemius muscles of the leg, the calf-stretching device comprising:

a support base positionable on a floor surface; and left and right surfaces separated by a center ridge, immovably attached to the support base, each of the left and right surfaces presenting a convex curved surface from a front side to a back side to receive respective feet of a user, the convex curved surface having a greater radial dimension on an inner portion than an outer portion to correspond to a foot arch of the user, wherein the convex curved surface comprises a progressively curved surface with an amount of curvature increasing from front to back thereby radius of curvature of the stretching surfaces changes along the perimeter of the device.

2. The calf-stretching device of claim 1, wherein the convex curved surface comprises a 3-25 degree slant.

3. The calf-stretching device of claim 2, wherein the convex curved surface comprises a 12-18 degree slant.

4. The calf-stretching device of claim 1, further comprising one or more resilient friction-producing supports attached to an under-surface of the support base to resist movement when the calf-stretching device is used in a back-against-a-wall technique.

* * * * *